US005259622A

United States Patent [19]

Irving

[11] Patent Number: 5,259,622

[45] Date of Patent: Nov. 9, 1993

[54] GOLF BALL TEEING APPARATUS

[76] Inventor: Elbert M. Irving, 115 Pulaski Rd., Chepachet, R.I. 02814

[21] Appl. No.: 917,844

[22] Filed: Jul. 21, 1992

[51] Int. Cl.[5] ..... A63B 57/00

[52] U.S. Cl. ..... 273/201

[58] Field of Search ..... 273/201, 33, 195 R, 273/DIG. 30, 202

[56] References Cited

U.S. PATENT DOCUMENTS

| | | | |
|---|---|---|---|
| 1,779,540 | 10/1930 | Haynes | 273/201 |
| 1,868,261 | 7/1932 | Spencer | 273/201 |
| 1,888,256 | 11/1932 | Baumgartner | 273/201 |
| 1,937,180 | 11/1933 | Young | 273/201 |
| 2,711,321 | 6/1955 | McGraw, Sr. | 273/201 |
| 2,716,973 | 9/1955 | Desi | 273/201 |
| 2,782,791 | 2/1957 | Sigo | 273/201 |
| 2,789,824 | 4/1957 | Willcox | 273/201 |
| 3,448,791 | 2/1957 | Sigo | 273/201 |
| 3,448,985 | 6/1969 | Scott | 273/201 |
| 3,458,204 | 7/1969 | Wilson | 273/201 |
| 4,194,648 | 3/1980 | Stanton | 273/201 |
| 4,253,668 | 3/1981 | Ose | 273/201 |
| 4,741,537 | 5/1988 | Adam | 273/201 |
| 4,995,614 | 2/1991 | Tange | 273/201 |
| 5,141,232 | 8/1992 | Durso | 273/DIG. 30 |

FOREIGN PATENT DOCUMENTS 8502126 5/1985 World Int. Prop. O. ..... 273/201

*Primary Examiner*—V. Millin
*Assistant Examiner*—Steven B. Wong
*Attorney, Agent, or Firm*—Albert W. Hilburger

[57] ABSTRACT

Portable golf ball teeing apparatus includes a large container providing a supply of golf balls, a fixed resilient tee at a location distant from the container, and a conduit extending generally between the container and the tee. The container is attached to an entry end of the conduit and a resilient spout is fixed to an exit end of the conduit and extends to a location just short of the tee. The conduit is angularly positioned on a platform supporting the conduit so that balls from the container are caused to descend by gravity towards the exit end and the height of the exit end above the platform is adjustable. A dwell opening defined by a circular lip somewhat smaller in diameter than a golf ball is formed in an undersurface of the conduit intermediate its ends to receive and temporarily hold a golf ball. An electric motor-driven delivery finger is selectively operated by a switch to rotate through an arc so as to engage a golf ball seated on the dwell opening, to lift the golf ball away from the lip, and to propel the ball toward the exit end and thereafter onto the tee.

17 Claims, 3 Drawing Sheets

GOLF BALL TEEING APPARATUS

BACKGROUND OF THE INVENTION

1. Field of the Invention

The present invention relates generally to golf ball teeing apparatus which provides a continuing supply of golf balls for placement, on demand, on a tee in position to be driven by a golf club and, more particularly, to improved teeing apparatus which is of simplified construction, portable, and can be easily used.

2. Description of the Prior Art

Novices to the game of golf, as well as more experienced players, seek to practice the swings or strokes of their clubs, both for driving and for putting. Such practice may be for exercise, although more likely to correct imperfections in the golfer's game, to improve both accuracy and distance. As a result, over the years, golf driving ranges have developed, apart from golf courses, provided with a large number of teeing locations, one for each individual golfer. Under this arrangement, in typical fashion, a golfer purchases a basket or bucket of balls and proceeds to drive them out onto a grassed fairway provided with markers to indicate successive distances. Of course, such an operation requires that, after each swing of the club and resulting drive of a ball off the tee, the golfer reach down into the basket to retrieve a ball and place it on the tee for the next swing. Such effort is time consuming and requires bending of the back of the golfer which can become uncomfortable after a period of time.

For this reason, there have been numerous attempts in recent years to provide golf ball teeing apparatus which can be operated automatically and/or on demand to "tee-up" a ball for the golfer's next swing, without requiring the golfer to bend down for the purpose. To this end, many constructions have been suggested for holding a plurality of golf balls in reserve, then advancing them, one by one, on demand or automatically, to a tee which is properly positioned for the golfer to strike the ball with a club.

Such prior art devices have generally been of a variety of complex constructions, sometimes electronically controlled, and usually with complicated mechanical linkages. They have not generally enjoyed commercial success due at least in part to the high initial costs of such complicated systems and further to their uneconomical operating and maintenance costs.

Typical of such prior art devices are the constructions disclosed in U.S. Pat. No. 1,779,540 to Haynes, U.S. Pat. No. 1,888,256 to Baumgartner, U.S. Pat. No. 2,711,321 to McGraw, Sr., U.S. Pat. No. 3,448,985 to Scott, and U.S. Pat. No. 3,458,204 to Wilson. In each instance, the mechanism is positioned beneath the level of the playing surface which would require that the device be permanently placed. In each instance, a foremost ball is advanced from a reserve of balls onto an initially depressed tee which is subsequently raised to an elevated position at a proper height for the ball to be driven off the tee. By reason of the construction of these devices requiring part of the structure to be located underground or beneath the playing surface, use by individual golfers away from a commercial golf driving establishment would not be readily feasible.

Other typical constructions are disclosed in U.S. Pat. No. 1,868,261 to Spencer and U.S. Pat. No. 1,937,180 to Young. While the major components of these devices are positioned above ground level, they too are of relatively complex construction. In addition, in each instance, the teeing member from which the ball is to be driven is integral with the remainder of the structure of the device. As a result, even if the teeing member is resilient as described in both patents, there is some amount of impact which must be absorbed by the rest of the structure of the device. This could be harmful to the device over an extended period of time. Furthermore, the teeing members are not of a conventional design which only support the ball at a minimized lowermost surface. Rather, in each instance, the teeing member supports the ball over an enlarged surface which would have an adverse effect on the impact of the club with the ball and the resulting delivery of the ball.

It was in light of the foregoing state of the prior art that the present invention was conceived and now has been reduced to practice.

SUMMARY OF THE INVENTION

The golf ball teeing apparatus of the invention may be portable and includes a large container providing a supply of golf balls, a fixed resilient tee at a location distant from the container, and a conduit extending generally between the container and the tee. The container is attached to an entry end of the conduit and a resilient spout is fixed to an exit end of the conduit and extends to a location just short of the tee. The conduit is angularly positioned on a platform supporting the conduit so that balls from the container are caused to descend by gravity towards the exit end and the height of the exit end above the platform is adjustable. A dwell opening defined by a circular lip somewhat smaller in diameter than a golf ball is formed in an undersurface of the conduit intermediate its ends to receive and temporarily hold a golf ball. An electric motor-driven delivery finger is selectively operated by a switch to rotate through an arc so as to engage a golf ball seated on the dwell opening, to lift the golf ball away from the lip, and to propel the ball toward the exit end and thereafter onto the tee.

The tee may be releasably mounted on the platform for replacement when worn or broken and a set of tees of different heights may be provided to accommodate different golfers.

In an alternative embodiment, the tee may be integrally attached to the conduit and an adjustment mechanism is provided for selectively adjusting the height of the tee.

Accordingly, it is a primary object of the invention to provide portable golf ball teeing apparatus which can be easily used both domestically and at commercial driving ranges.

Another object of the invention is to provide such apparatus which is of simple construction using readily available, yet durable, materials.

A further object of the invention is to provide such apparatus which is economical from a standpoint of fabrication as well as from a standpoint of use.

Still another object of the invention is to provide such apparatus which is substantially fail safe in its operation and totally safe in its use.

Yet another object of the invention is to provide such apparatus which is compact, light in weight, self-contained, portable, and which can be set up for immediate use almost anyplace.

Still a further object of the invention is to provide such apparatus which can be use for both driving and putting.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate some of the embodiments of the invention and, together with the description, serve to explain the principles of the invention in general terms. Like numbers refer to like parts throughout the disclosure.

DETAILED DESCRIPTION OF THE PREFERRED EMBODIMENTS

Figure 1:
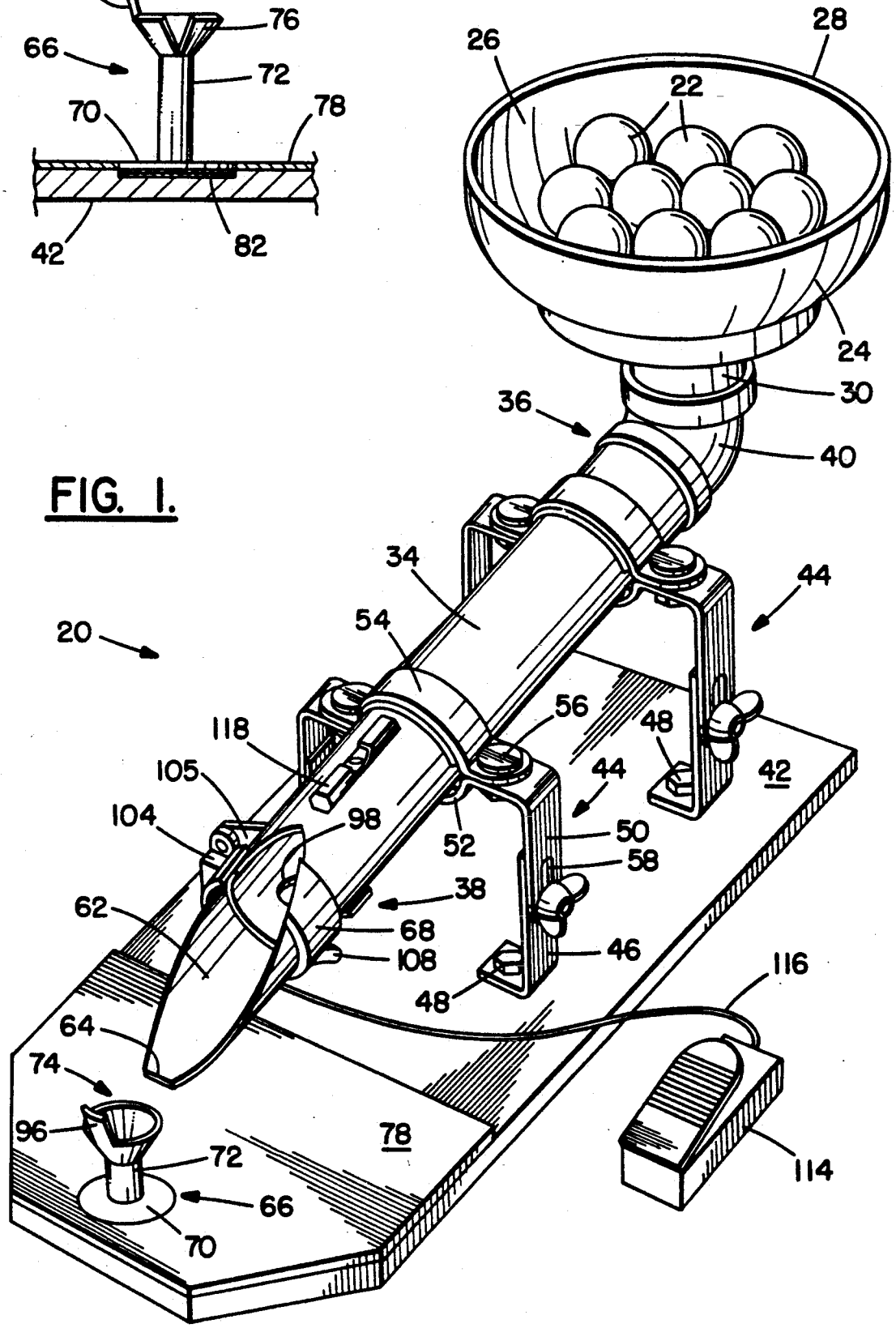
FIG. 1 is a perspective view of golf ball teeing apparatus generally embodying the invention.
Figure 2:
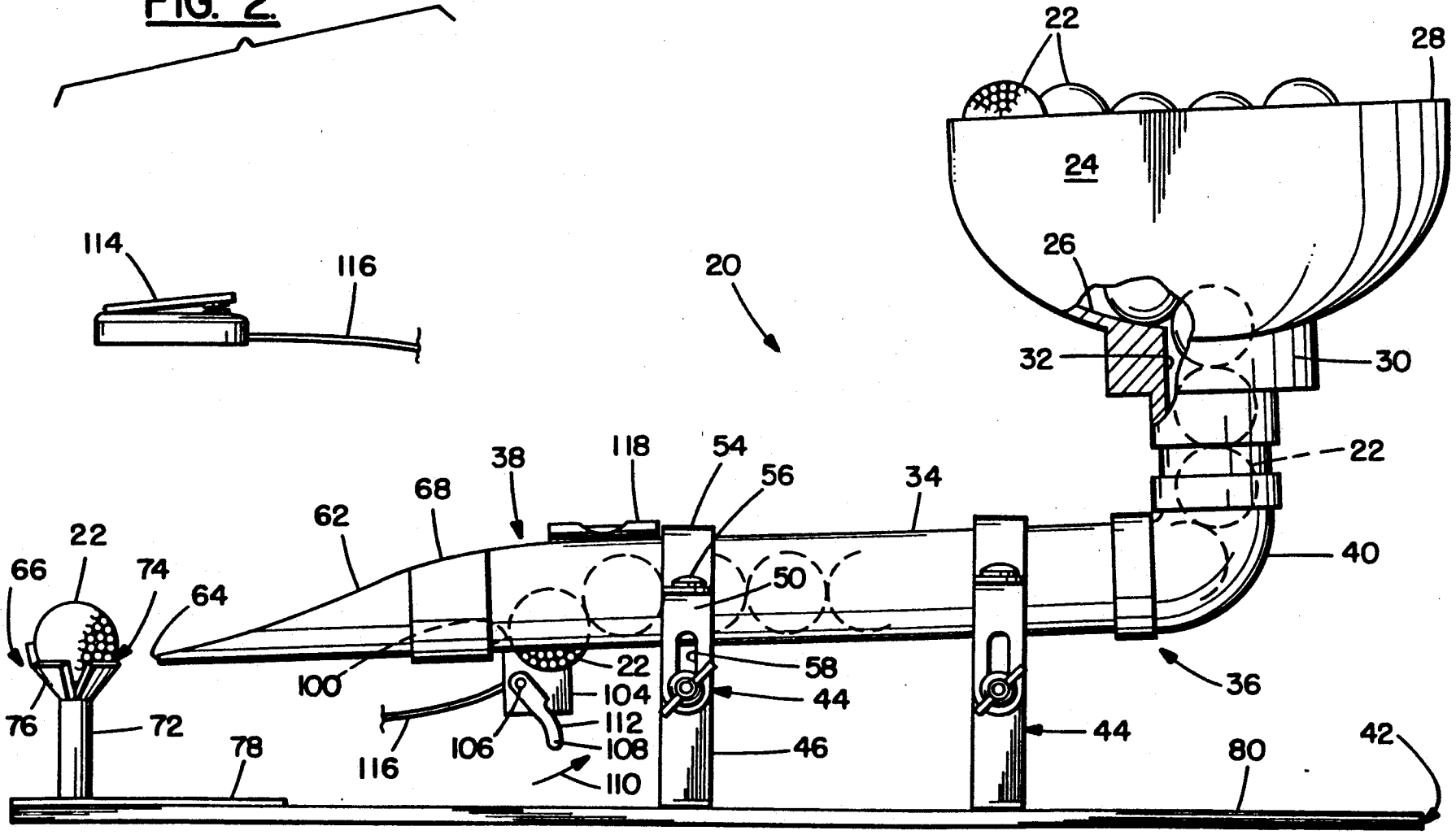
FIG. 2 is a side elevation view of the apparatus illustrated in FIG. 1, certain parts being cut away and shown in section.

Turn now to the drawings and, initially, to FIGS. 1 and 2 which generally illustrate golf ball teeing apparatus 20 which embodies the present invention. A source of supply of golf balls 22 is provided in the form of a hollow vessel 24 which has an internal supporting surface 26 extending between an upper opening defined by a peripheral rim 28 through which golf balls can be inserted and a neck 30 having a lower opening 32 (FIG. 2) through which only one golf ball can freely pass at a time.

A conduit in the form of an elongated tubular member 34 extends between an entry end 36 and an exit end 38 for serially supporting a plurality of golf balls 22 from the vessel 24. A hollow elbow member 40 connects the entry end 36 of the tubular member 34 and the neck 30 of the vessel 24 in such a manner that the interior of the tubular member is in communication with the interior of the vessel 24.

The tubular member 34 is supported on a generally planar platform 42 by means of a pair of longitudinally spaced support structures 44 which maintain the tubular member 34 a spaced distance above the platform and angularly disposed relative to the platform to assure that golf balls inside the tubular member are urged by gravity to roll from the entry end 36 toward the exit end 38.

The support structures 44 may be of a fixed construction, but, preferably, are adjustable. To this end, each support structure 44 includes a pair of laterally spaced L-brackets 46, each being suitably fixed to the platform 42 by means of a suitable fastener 48. An upper transverse bracket 50 includes a central cradle portion 52 which engageably receives an underside of the tubular member 34. An upper collar 54 engageably straddles an upper surface of the tubular member 34 and is attached at its opposite ends to the transverse bracket by means of suitable fasteners 56. The upright portions of the transverse bracket 50 are slotted as at 58 and receive therethrough a wing screw 60, or other suitable fastener, which is threadedly engaged with a tapped bore (not shown) through the L-bracket 46.

With this construction, the height of the tubular member 34 above the platform 42 is adjustable as well as its angularity relative to the platform.

A flexible spout 62 is fixed to the exit end 38 of the tubular member 34 and extends to a tip end 64 which is adjacent to but spaced from a golf ball tee 66. The spout 62 may be attached in any suitable manner, as by rivets or the like. As illustrated, however, and as preferred, a resilient ring 68 of suitable plastic material, for example, encircles the spout 62 at its innermost end and holds it firmly in engagement with the exit end 38 of the tubular member 34. By means of this construction, the spout can be readily removed and replaced, whenever desired.

Figure 4:
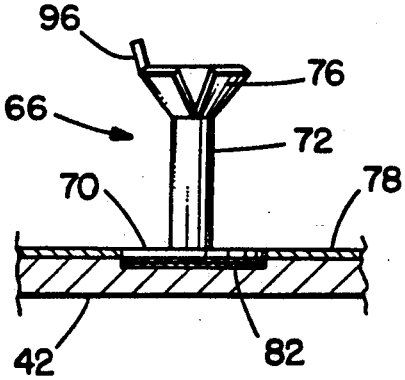
FIGS. 4, 5, and 6 are detail cross section views depicting three different embodiments of tee mounting constructions which can be used with the invention.

The tee 66 is intended to be stationary on the platform 42. It is of resilient, rubber-like material and includes a base 70, an upstanding spindle member 72, and an upwardly flared conical member 74 which defines a nest for supporting a golf ball 26 on the tee 66. In a preferable construction, as seen in FIGS. 2, 3, and 4, the ball support member 74 is divided into a plurality of individual circumferentially spaced segments 76 which readily separate at the time the head of a golf club impacts against the ball 22 and thereby offer minimal interference with the stroke.

Figure 3:
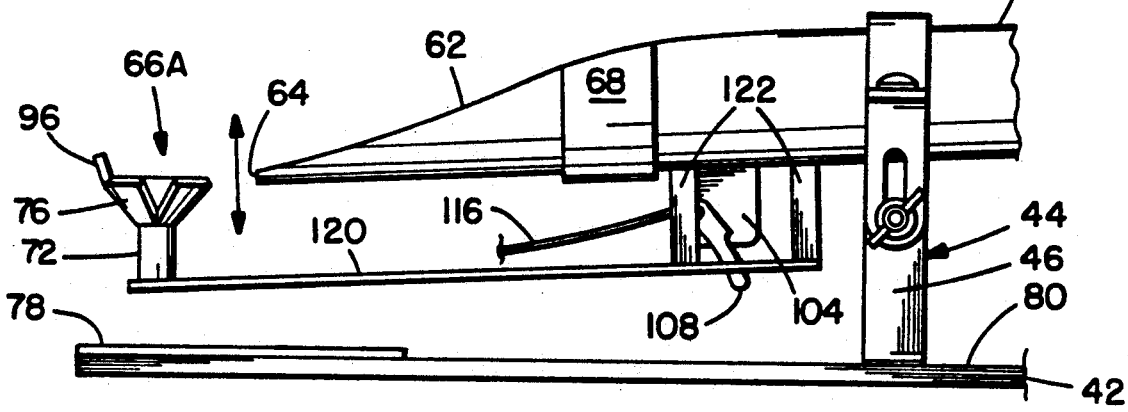
FIG. 3 is a side elevation view of another embodiment of the apparatus illustrated in FIGS. 1 and 2.

As seen in FIGS. 1, 2, and 3, artificial turf 78 may be provided on an upper surface 80 of the platform 42 for attempted realism. In such an instance, a circular portion of the turf 78 may be removed, as seen in FIG. 1, to receive the base 70 of the tee 66 to allow the base to be suitably fastened directly to the upper surface 80 of the platform 42. While the base 70 may be attached to the upper surface 80 by means of a suitable adhesive, it would be preferable for the tee 66 to be capable of removal from the platform, permitting its replacement. In such an instance, hook and loop fastening material 82 such as that sold under the trademark "VELCRO" may be used as seen in FIG. 4. Removal and replacement of a tee may be desirable in order to place a worn or broken tee. It may also be desirable to customize the apparatus 20 by providing a tee with spindle members 72 of different lengths in order to accommodate the wishes of different golfers.

Figure 5:
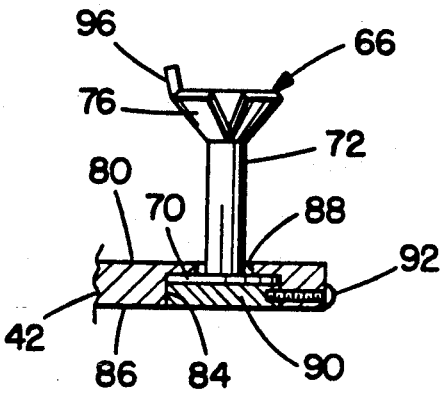

A different tee mounting arrangement is illustrated in FIG. 5. In this instance, a recess 84 is formed in a lower surface 86 of the platform 82 and an associated bore 88 connects the recess 84 with the upper surface 80. The diameter of the bore is larger than the spindle member 72. The recess 84 is adapted to freely or fittingly receive the base 70 of the tee 66 and when that occurs, the spindle member 72 extends freely through the bore 88. It will be appreciated that in order for the spindle member 72 to be passed through the bore 88, the segments 76 will have been flattened down to the diameter of the spindle member, then inserted through the bore 88. In order to hold the base 70 of the tee 66 within the recess 84, a block member 90 having a size and configuration which is generally equivalent to that of the recess is inserted to overlie the base and is, in turn, held in place by means of a suitable fastener 92 affixing it to the platform 42.

Figure 6:
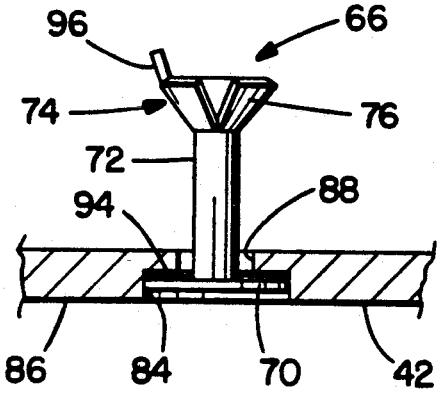

Yet another construction is depicted in FIG. 6. In this instance, hook and loop fastening material 94 is provided between the mating surfaces of the base 70 and of the recess 84.

The conical ball support member 74 is also desirably provided with a barrier member 96 which extends upwardly at a circumferential location distant from the spout 62 and from the exit end 38 of the tubular member 34. The barrier member serves to prevent further movement of the ball 22 as it travels from the tubular member 34.

Figure 7:
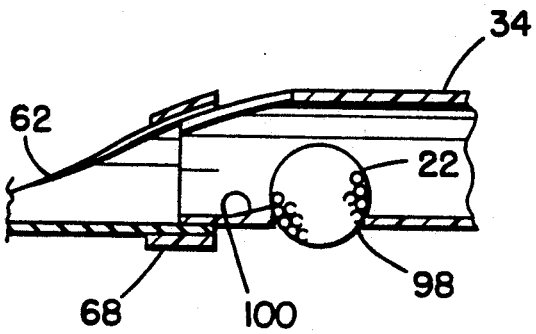
FIG. 7 is a detail cross section view illustrating a dwell mechanism utilized by the invention for temporarily holding a golf ball prior to delivering it onto the tee.
Figure 8:
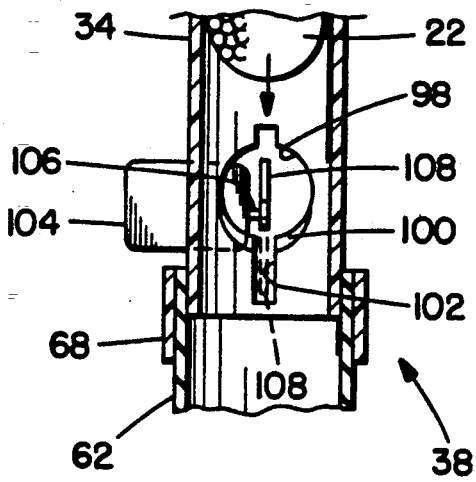
FIG. 8 is a detail top plan view illustrating the dwell mechanism depicted in FIG. 7.

As best seen in FIGS. 7 and 8, the tubular member 34 is provided with a dwell opening defined by a circular lip 98 which extends through an under surface of the tubular member 34. The circular lip 98 is positioned intermediate the entry end 36 and the exit end 38 and has a diameter smaller than that of a golf ball 22. In this manner, the circular lip 98 is effective to receive and hold a golf ball as it rolls through the interior of the tubular member 34 from the vessel 24. It operates to temporarily prevent the foremost ball of a series of balls from any further advance toward the exit end 38. As a further end in capturing a ball 22, a stop member 100 is provided in the form of a raised region adjacent the circular lip and nearest the exit end 38. Additionally, a longitudinal slot 102 extends between the circular lip 98 and the exit end of the tubular member 34.

An electric motor 104 is suitably mounted on the tubular member 34 by means of a bracket 105 (FIG. 1) and has an output shaft 106 (FIGS. 2 and 8) which extends substantially perpendicular to a longitudinal axis of the tubular member 34 and lies in a plane substantially parallel to the upper surface of the platform 42. The output shaft is adjacent the dwell opening defined by the circular lip 98. A delivery finger 108 is mounted on an extremity of the output shaft 106 for rotation therewith through an arc which extends through the dwell opening and through the slot 102. As seen in FIG. 2, the delivery finger 108 rotates in the direction of an arrow 110 until a convex surface 112 engages a golf ball 22 positioned at the dwell opening. As the delivery finger 108 continues to rotate, its convex surface 112 engages the ball 22, lifting the ball away from the circular lip 98 and propelling it toward the exit end 38 and eventually onto the tee 66.

The motor 104 may be operated by means of a foot switch 114 connected electrically to the motor by means of a suitable electrical lead 116. It will be appreciated that the motor 104 may be battery powered or it may be powered from a main electrical supply of A.C. power. Also, the motor 104 may be of a type which rotates one cycle only upon operation of the switch 114 or which rotates only so long as the switch 114 is activated. In any event, the golfer will receive a ball on the tee 66 whenever he or she so chooses.

In operation, a golfer properly places the apparatus 20 at a chosen location and stands beside the apparatus in position to swing at a ball 22 on the tee 66. When a swing is completed and the ball 22 is driven from the tee 66, the golfer then operates the switch 114 to call for placement of another ball on the tee 66. When the switch is actuated, the delivery finger 108 is operated to deliver the next succeeding ball onto the tee 66, the barrier member 96 assuring that a delivered ball will not travel beyond the conical ball support member 74. If the tee 66 is too high, it can be replaced with another tee having a shorter spindle member 72 utilizing any of the constructions illustrated in FIGS. 4, 5, and 6. Additionally, by means of the adjustable support structures 44, the height and angularity of the tubular member 34 can be adjusted to accommodate the new tee. A level 118 of conventional design may be provided on an upper surface of the tubular member 34 to indicate the angularity of the tubular member relative to the platform 42.

Another embodiment of the invention is depicted in FIG. 3. In this instance, a strut 120 is supported beneath the tubular member 34 by means of downwardly extending brackets 122 suitably fixed to the tubular member. The strut 120 extends in a direction generally parallel with that of a longitudinal axis of the tubular member 34 and extends beyond the tip end 64 of the spout 62. A tee 66A is suitably attached to an extremity of the strut 120 at a location proximately spaced from the tip end 64. By reason of this construction, the tee 66A is fixed relative to the tubular member 34. However, the entire unit comprising the tubular member 34 and the tee can be height adjusted by means of the support structures 44 which are similar to the embodiment illustrated in FIGS. 1 and 2. In all other respects, the embodiment of FIG. 3 operates in the manner of the previously described embodiment.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. Golf ball teeing apparatus comprising:

a generally planar platform having upper and lower surfaces;

supply means for containing a plurality of golf balls, said supply means being a hollow vessel having an internal supporting surface extending between an upper opening defined by a peripheral rim through which golf balls can be inserted and a neck having a lower opening through which only one golf ball can freely pass at a time;

stationary tee means having a supporting surface distant from said supply means positioned to receive a golf ball thereon;

conduit means for guiding golf balls from said supply means to said tee means, said conduit means including:

an elongated tubular member extending between an entry end and an exit end for serially supporting therein a plurality of golf balls;

a hollow elbow member connecting said entry end of said tubular member and said neck of said vessel such that the interior of said tubular member is in communication with the interior of said hollow vessel; and support means connecting said tubular member and said platform and supporting said tubular member above said upper surface angularly disposed such that, when said platform is level, golf balls inside said tubular member are urged by gravity to roll from said entry end toward said exit end;

said conduit means having dwell means for receiving and releasably holding an individual golf ball, said dwell means including a circular lip defining a dwell opening extending through an undersurface of said tubular member, said circular lip being positioned intermediate said entry end and said exit end and having a diameter smaller than that of a golf ball, such that said circular lip is effective to receive and hold a golf ball and temporarily prevent its further advance toward said exit end; and delivery means adjacent said dwell means engageable with a golf ball positioned at said dwell means for advancing it to said tee means, said delivery means including:

an electric motor mounted on said tubular member and having an output shaft extending substantially perpendicular to an axis of said tubular member and substantially parallel to said upper surface of said planar platform, said output shaft being adjacent the dwell opening in said undersurface of said tubular member;

a delivery finger mounted on said output shaft for rotation therewith through an arc which extends through the dwell opening and being thereby engageable with a golf ball seated on said circular lip to lift the golf ball away from said lip and propel the golf ball toward said exit end and thereafter onto said tee means; and switch means for selectively operating said electric motor to rotate said delivery finger on said output shaft.

2. Golf ball teeing apparatus as set forth in claim 1 including: a flexible spout fixed to said exit end of said tubular member and extending to a tip end adjacent to but spaced from said tee means.

3. Golf ball teeing apparatus as set forth in claim 1 wherein said dwell means includes a stop member integral with said circular lip on the region of said circular lip nearest the exit end of said tubular member.

4. Golf ball teeing apparatus as set forth in claim 1 wherein said support means includes:

first and second support members positioned at longitudinally spaced locations along said tubular member for maintaining said tubular member slightly angularly disposed above said upper surface of said planar platform such that said exit end is closer to said upper surface than said entry end.

5. Golf ball teeing apparatus as set forth in claim 4 wherein each of said first and second support members includes adjustment means for adjusting the distance between said tubular member and said platform.

6. Golf ball teeing apparatus as set forth in claim 5 including level means on said tubular member for indicating the attitude of said tubular member relative to said upper surface.

7. Golf ball teeing apparatus as set forth in claim 1 wherein said tee means is flexible; and includes:

an upstanding spindle member;

an upwardly flared conical member integral with said spindle member defining a nest for supporting a ball thereon; and a barrier member on said conical member at a location distant from said exit end of said tubular member for preventing further movement of the ball as it travels from said tubular member.

8. Golf ball teeing apparatus as set forth in claim 7 wherein:

said tee means includes a base integrally mounting said spindle member; and means for releasably mounting said base on said platform.

9. Golf ball teeing apparatus as set forth in claim 8 wherein said releasable mounting means includes hook and loop fastening material.

10. Golf ball teeing apparatus as set forth in claim 8 wherein said platform has a recess formed in its lower surface and an associated bore therethrough connecting the recess with said upper surface, the bore having a diameter larger than said spindle member, the recess adapted to receive said base of said tee means therein such that said spindle member extends freely through the bore; and including:

means for releasably mounting said base to said platform.

11. Golf ball teeing apparatus as set forth in claim 7 wherein said support means connecting said tubular member and said platform and includes adjustment means for selectively adjusting the height of said exit end above said platform.

12. Golf ball teeing apparatus as set forth in claim 11 including: means for locking said adjustment means when a desired height of said exit end above said platform is achieved.

13. Golf ball teeing apparatus as set forth in claim 1 wherein said support means connecting said tubular member and said platform includes adjustment means for selectively adjusting the height of said exit end above said platform.

14. Golf ball teeing apparatus as set forth in claim 13 including:

means for locking said adjustment means when a desired height of said exit end above said platform is achieved.

15. Golf ball teeing apparatus comprising:

a generally planar platform having upper and lower surfaces;

supply means for containing a plurality of golf balls, said supply means being a hollow vessel having an internal supporting surface extending between an upper opening defined by a peripheral rim through which golf balls can be inserted and a neck having a lower opening through which only one golf ball can freely pass at a time;

stationary teen means having a supporting surface distant from said supply means positioned to receive a golf ball thereon, said tee means including:

an upstanding flexible spindle member;

a bas integrally mounting said spindle member;

means for releasably mounting said base on said platform;

an upwardly flared conical member integral with said spindle member defining a nest for supporting a ball thereon; and a barrier member on said conical member at a location distant from said exit end of said tubular member for preventing further movement of the ball as it travels from said tubular member;

said platform having a recess formed in its lower surface and an associated bore therethrough connecting the recess with said upper surface, the bore having a diameter larger than said spindle member, the recess adapted to receive said base of said tee means therein such that said spindle member extends freely through the bore; and including:

means for releasably mounting said base to said platform;

conduit means for guiding golf balls from said supply means to said tee means, said conduit means including:

an elongated tubular member extending between an entry end and an exit end for serially supporting therein a plurality of golf balls;

a hollow elbow member connecting said entry end of said tubular member and said neck of said vessel such that the interior of said tubular member is in communication with the interior of said hollow vessel; and support means connecting said tubular member and said platform and supporting said tubular member above said upper surface angularly disposed such that, when said platform is level, golf balls inside said tubular member are urged by gravity to roll from said entry end toward said exit end;

said conduit means having dwell means for receiving and releasably holding an individual golf ball; and delivery means adjacent said dwell means engageable with a golf ball positioned at said dwell means for advancing it to said tee means.

16. Golf ball teeing apparatus as set forth in claim 15 wherein said releasable mounting means includes hook and loop fastening material.

17. Golf ball teeing apparatus as set forth in claim 15 wherein said releasable mounting means includes:

a block member receivable in the recess formed in the lower surface of said platform engageable with said base to thereby capture said base in the recess; and fastening means for releasably joining said block member to said platform.

* * * * *